United States Patent [19]

Russell et al.

[11] 4,113,821

[45] Sep. 12, 1978

[54] PROCESS FOR PREPARING HIGH STRENGTH POLYAMIDE AND POLYESTER FILAMENTARY YARN

[75] Inventors: William Norman Russell; James Isaac Bruton, both of Colonial Heights; Ian Charles Twilley, Chesterfield County, all of, Va.

[73] Assignee: Allied Chemical Corporation, Morris Township, Morris County, N.J.

[21] Appl. No.: 829,764

[22] Filed: Sep. 1, 1977

Related U.S. Application Data

[63] Continuation of Ser. No. 689,236, May 24, 1976, abandoned, which is a continuation of Ser. No. 555,494, Mar. 5, 1975, abandoned, which is a continuation of Ser. No. 183,224, Sep. 23, 1971, abandoned.

[51] Int. Cl.[2] ..... D01D 5/12

[52] U.S. Cl. ..... 264/210 F; 264/176 F

[58] Field of Search ..... 264/176 F, 260 F, 290 T

[56] References Cited

U.S. PATENT DOCUMENTS

| | | | |
|---|---|---|---|
| 3,216,187 | 11/1965 | Chantry et al. | 264/210 F |
| 3,361,859 | 1/1968 | Cengato | 264/210 F |
| 3,715,421 | 2/1973 | Martin et al. | 264/210 F |
| 3,936,253 | 2/1976 | Fisher et al. | 264/210 F |

*Primary Examiner*—Jay H. Woo

*Attorney, Agent, or Firm*—Fred L. Kelly

[57] ABSTRACT

Preparation of improved yarns from synthetic linear polymer filaments by melt spinning followed by substantially immediately heating said filaments above their second order transition temperature and drawing said filaments substantially instantly at a temperature in the range of from about above their second order transition temperature to within about 5° C. of their melting point, said heating being preceded by pretensioning of said filaments at a constant tension level greater than about 0.005 gram per denier and less than a tension level required to draw said filaments.

3 Claims, No Drawings

PROCESS FOR PREPARING HIGH STRENGTH POLYAMIDE AND POLYESTER FILAMENTARY YARN

This is a continuation, of application Ser. No. 689,236, filed May 24, 1976 now abandoned, which is a continuation of application Ser. No. 555,494, filed Mar. 5, 1975, now abandoned, which is a continuation of application Ser. No. 183,224, filed Sept. 23, 1971, now abandoned.

BACKGROUND OF THE INVENTION

This invention relates to an improved continuous process for drawing melt spun multifilaments of synthetic linear polymer undrawn yarns. More particularly, this invention relates to an improved continuous process for drawing melt spun multifilament polyamide or polyester undrawn yarns of varying viscosity and denier per filament, drawing rates ranging from about 1,000 to about 15,000 feet per minute drawn fiber while using a feed area pretension zone for the undrawn yarn. Still more particularly, this invention yields an improved drawn fiber product having improved toughness (energy required to break) and fewer mechanical defects (broken filaments, sloughs, loops, etc.).

Processes for the production of polyamide and polyester filaments useful for textile and industrial purposes are known. Such products can be prepared by extruding molten polyamide or polyester polymer through a spinnerette, quenching the filaments and winding up the quenched filaments. To obtain useful properties, it is known that the filaments must be drawn several times their original length, thereby orienting the filament molecules. The spinning and drawing steps are commonly carried out separately. That is, with two machines, namely, a spinning machine followed by a machine for drawing and/or twisting or both simultaneously.

Many attempts have been made to combine all these operations into one operation for obvious reasons. For example, U.S. Pat. No. 2,604,667 proposes the production of synthetic linear polyesters by a high speed process for melt spinning to produce useful products as spun fibers and yarns. Another attempt is shown for the production of uniformly oriented textile yarn in U.S. Pat. No. 3,002,804 wherein the melt spun quenched filaments are passed through a liquid drag bath during drawing in an effort to control temperature and tension. Still, another method is illustrated in British patent specification No. 1,168,767 wherein the filaments are passed over a so-called drag pin. Such processes, as well as others, have been proposed in an effort to tailor process and equipment which will yield an improved product.

It can readily be seen that considerable economic processing and end product advantages would be achieved by providing a preferred product via a combined spinning and drawing operation. First, one machine would now do that which heretofore took two machines to accomplish, thereby requiring less machinery and manpower application. Secondly, the filamentary yarn produced is handled much less and, therefore, is not subject to as many operational steps or process conditions, therefore eliminating considerable yarn deterioration.

Further, to produce an improved high speed process that yields improved synthetic linear polymer multifilament yarns in a continuous manner wherein the spinning and drawing is accomplished in a so-called one step process utilizing a single machine would indeed make a contribution to this art.

It has now been found that in accordance with this invention, the processing equipment has been simplified which results in a simple yet flexible process for producing high quality polyamide or polyester fibers. It has now been found that a specific unexpected relationship exists with reference to the various functions of spinning and drawing which can be combined in order to yield an operable process at high speeds while producing high quality yarn.

It is, therefore, a primary object of this invention to produce high quality synthetic linear polymer multifilament yarns useful for both textile and industrial end uses.

A further object is to provide an improved process and product for producing continuously a high quality fiber product.

Another object is to provide an improved process for continuously producing an improved quality fiber product by melt spinning followed immediately by drawing of the spun fibers without prior winding up.

Another particular object of this invention is to provide a process for drawing substantially immediately and without prior wind-up a freshly melt-spun undrawn multifilament yarn to provide an oriented yarn of improved toughness with fewer mechanical defects than that obtained by prior art processes.

The objects of this invention are accomplished in a continuous high speed process which comprises extruding molten synthetic linear polymer through a spinnerette into undrawn filaments at a temperature between about 235° C. and about 380° C., pretensioning said filaments continuously at a constant tension level greater than about 0.005 gram per denier (undrawn) and less than a tension level required to draw said filaments, heating said filaments substantially immediately above their second order transition temperature, drawing said filaments substantially instantly subsequent to said heating at a temperature in the range of from about above their second order transition temperature to about 5° C. below their melting point when winding up said drawn filaments.

Subsequent treatments such as bulking, interlacing, sizing, etc. are also usually required to produce a product acceptable for specific product applications. This invention provides improvements in the drawing or combined spinning and drawing process and provides an improved product therefrom.

The term "melt-spun" fibers is defined as fibers formed from molten linear polymers which are shaped by extruding from fine orifices. Examples are condensation polymers, such as, polyamides and polyesters, as well as, addition polymers such as polyethylene, polypropylene and polyvinylchloride. Copolymers of condensation polymers and addition polymers are also included. These polymers may be chemically pure or may contain additives to provide specific end product properties such as $TiO_2$ for low luster amine, phenolic or other known heat stabilizers, etc.

The term "breaking strength" is defined by ASTM Standards, Part 24, American Society for Testing and Materials, 1916 Race Street, Philadelphia, Pa., page 33 (1965) as "the maximum resultant internal force that resists rupture in a tension test", or "breaking load or force, expressed in units of weight required to break or rupture a specimen in a tensile test made according to specified standard procedures".

The term "toughness", taken from the same reference book is defined as "the actual work per unit volume or per unit mass of material which is required to rupture the material. It is proportional to the area under the load elongation curve from the origin to the breaking point."

The term "shrinkage" is defined as "percent decrease in length of a material when exposed to elevated temperatures for a specified period of time".

The term "intrinsic viscosity" is used herein as a measure of the degree of polymerization of the polyester and is determined from the equation $$[\eta] = \sqrt{\frac{1 + 1.4 \times \eta\text{spec-}1}{0.35}}$$

wherein "$\eta$ specific" means the specific viscosity at 25° C. of a solution of 0.5000 gram of polyethylene terephthalate in 100 milliliters of a mixture of equal parts by weight of phenol and tetrachloroethane (B. B. Petukhov, *The Technology of Polyester Fibers,* The Macmillan Company, New York, 1963, page 31).

The term "Relative Formic Acid Viscosity" is defined in "ASTM Method No. D-789-53T".

The pretensioning of the filamentary yarn is preferably carried out by use of a roll assembly, such as, a roll-idler roll assembly, nip roll, or stepped roll in conjunction with the feed rolls of a drawing zone positioned between and including the feed rolls and the draw rolls wherein a heated fluid is jetted onto the yarn in a symmetric fashion with reference to the yarn threadpath.

Pretensioning may also be accomplished through the use of so-called snubbing pins or by tension discs or any other means of providing a uniform tension to the yarn advancing to the draw zone feed rolls. The pretension is critical within certain bounds. It has been found that in order to operate the process successfully and obtain an improved and uniform quality product, it is necessary to maintain the pretensioning of the yarn at a constant tension level greater than about 0.005 gram per denier and less than a tension level required to draw said filaments. The most preferred pretensioning range is from about 0.005 gram per denier and about 0.15 gram per undrawn denier. This preferred tension range allows the preparation of a more uniform drawn yarn with particularly fewer mechanical defects and improved strength and toughness.

The criticality of the yarn pretensioning can readily be observed when applicants' invention is reviewed in relation to the prior art spin-drawn process. In accordance with prior art methods, a synthetic undrawn amorphous filament bundle is continuously extruded and withdrawn through a quenching zone with a set of rolls. The same set of rolls is also used to advance the amorphous, undrawn bundle into a drawing or stretching zone. The only tension applied to the undrawn yarn prior to stretching or drawing is the spinning tension which is generally nonuniform and less than 0.005 gram per denier and said tension fluctuates quite significantly due to the various physical forces necessarily acting upon it in this environment. The fluctuation of spinning tensions normally results in excessive movement of the undrawn yarn entering the drawing zone. This movement becomes even more severe if any heat is applied to the said undrawn yarn prior to stretching. Further, yarn fluctuations are obtained in any quenching process and especially one wherein a cross flow quenching system is used. Applicants have observed that in their process pretensioning of the yarn within these ranges essentially reduces all undesirable yarn movement on and around the feed rolls, thus allowing yarn entry into the draw zone to maintain a steady position which results in superior drawn fibers particularly in uniformity of processing performance and physical properties of the fibers.

Another interrelating feature of this invention resides in maintaining the yarn entry into the draw point localizing zone in a steady position so said filaments substantially immediately as an entity are heated above their second order transition temperature and drawing said filaments substantially instantly subsequent to said heating at a temperature in the range of from about above their second transition temperature to within about 5° C. of their melting point. The draw point localizing zone in this invention preferably utilizes a heated fluid which substantially instantly heats the yarn above its second order transition temperature. At the selected temperature the molecules possess enough energy to permit mobility, and as the relative location of the draw point localizing zone is placed between the feed rolls and the draw rolls, the yarn is drawn in accordance with the predetermined speed differential between the feed rolls and the draw rolls. Therefore, the pretension roll system provides yarn pretension sufficient to stabilize the yarn in a steady position allowing a steady, uniform tension on said yarn and a stabilized yarn path into the draw point localizer zone.

Interrelationships of orifice size of the fluid jet type draw point localizer zone, roll system placement in relation to said orifice, fluid temperature and pressure levels, yarn tension and temperature levels in relation to spun denier are critical to obtaining the improved process and product of this invention.

The interior passage diameter of the fluid jet type draw point localization zone is sufficient in size to allow the yarn bundle to expand and even to vibrate without contacting the interior wall surfaces. If controlled pretension is not used, alignment problems occur, and the yarn touches the hot wall surfaces of the draw point localizer then such alignment problems allow nonuniformity in substantially all physical properties of the finished yarn. The elimination of problems concerning alignment of the yarn allows individual filaments to move freely, thereby permitting heated fluid to pass freely through the bundle for more uniform and substantially instantaneous heat transfer.

In operation, the synthetic linear polymer is melted, pumped and extruded continuously through a spinnerette to form a plurality of filaments, quenching the filaments by means of a quench system using air, inert gas, or other fluid, applying to the filaments a lubricating finish, passing the filaments at controlled speed successively over a converging guide, a pretensioning system, a feed roll system, a draw point localizing zone, a draw roll system, one or more post treating systems for relaxing, compacting, sizing, texturing, etc. and finally to a wind-up or other packaging system. The entire spinning and drawing system may be enclosed during operation. The arrangement, as well as the temperature of the rolls are variable within limits to yield the improved process and yarn product.

The yarn pretensioning system is preferably located just prior to the feed roll system. The pretensioning system induces uniform tensions upon the undrawn yarn and preferably controls the pretension within between about 0.005 and about 0.15 gram per denier. The pretension can be controlled based on the speed difference in the yarn pretensioning roll system and the feed roll system. The feed roll system is arranged in such a way as to accommodate the yarn filaments received from the yarn pretensioning roll system and provide for alignment of the yarn into the draw point localizer zone as said yarn exits said feed roll system.

The draw point localizing zone allows the yarn filaments to be heated substantially immediately above their glass transition temperature.

A draw point localizer as applied to this invention is not limited to a heated fluid jet as described herein but may comprise any technique and equipment for uniformly applying sufficient heat to the yarn to localize the point between the feed roll and draw roll systems at which the yarn filaments neck down from substantially the diameter of the undrawn filaments to substantially the diameter of the drawn filaments. Examples of such other heating techniques include high intensity infrared radiation, ultrasonics, laser, etc.

When using a fluid jet localizer, a preferred fluid is steam which is maintained in the temperature range of 400°–475° C. with the preferred range of 440°–450° C. for high speed drawing of polyethylene terephthalate. The orifice size or diameter is quite critical and must be sufficient in size to allow the yarn to traverse, expand and vibrate without contacting the interior surfaces of the orifice. Preferably, the draw point localization zone contains fluid entrances positioned at angles to the path of the yarn in such a manner as to allow the fluid flow to be concurrent to the yarn direction. An external guide may be used just prior to the draw point localizing zone to substantially gather the filaments into a symmetrical bundle and direct said bundle into the center of said draw point localizing zone.

The flow of the hot fluid enters into the draw point localizing zone in a substantially symmetrical manner and envelopes, expands and vibrates the yarn filament bundle in such a way to substantially immediately heat the yarn filament bundle above its glass transition temperature wherein drawing is readily achieved.

As the yarn leaves the draw point localizing zone, it is withdrawn by a draw roll system. The draw roll system arrangement and placement are designed so as to allow proper alignment with the preceding draw point localizing zone. The draw roll system temperature can be controlled between about ambient room temperature and about 245° C. The yarn normally then proceeds to a relaxing roll system, through a yarn compacting system and to a wind-up system.

The following examples further illustrate the present invention only and are not to be considered limiting of the invention in any manner.

EXAMPLE I

This example illustrates the combined spinning and drawing utilizing polyethylene terephthalate polymer. Polyethylene terephthalate polymer having an intrinsic viscosity of 0.95 was melted in an apparatus at 295° C. and pumped through a filter to a 192 hole spinnerette. The spinning temperature was maintained within plus or minus 2 degrees centigrade by use of a Dowtherm liquid vapor temperature control system. The throughput rate of 45 pounds per hour was maintained by an inlet pump pressure of 800 psi and an outlet pressure of 7500 maximum. The extruded filaments were quenched in ambient room temperature air. The filaments prior to convergence were lubricated by use of a rotating finish roll. From the convergence point, the yarn bundle passed over in three wraps a yarn pretensioning roll system maintained at ambient room temperature and operating at 1383.4 feet per minute with a denier of 7500. The yarn then passed over in ten wraps a feed roll system maintained at ambient room temperature and operating at 1391.1 feet per minute. The predraft tension was maintained at 0.03 gram per denier based upon the speed difference in the yarn pretensioning roll system and the feed roll system. The yarn bundle was then fed through the draw point localizing zone wherein the hot fluid (steam) temperature was 450° C. and the pressure was 122 psig. The yarn then passed over the draw roll system maintained at a temperature of 130° C. and operating at a surface speed of 8198 feet per minute. The yarn bundle was then allowed to relax prior to being wound up by passing the yarn over a heated roll system controlled at a surface temperature of 160° C. and surface speed of 7813 feet per minute. The yarn was then wound up. The properties of yarn produced under the above-described conditions (A), yarn spun and drawn under prior art conditions, (B), and yarn currently sold in the trade for the same use, (C) are shown in Table I. It is apparent that the properties and mechanical quality of the yarn produced from this invention are superior to the yarns produced by the prior art.

TABLE I

| Sample | Fiber I. V. | Denier | Tenacity (gpd) | Elongation at Break % | Toughness | Thermal Shrinkage (%) | Pre-Tension (gpd) | Tensile Modulus (gpd)* | B.Q.I.** |
|---|---|---|---|---|---|---|---|---|---|
| A | 0.89 | 1318 | 9.2 | 18.7 | 0.90 | 5.7 | 0.03 | 100 | 20 |
| B | 0.88 | 1320 | 9.0 | 10.5 | 0.48 | 12.0 | — | 121 | 350 |
| C | 0.90 | 1315 | 8.7 | 13.7 | 0.74 | 6.3 | — | 113 | 210 |

*Tensile Modulus - Stress at 100% elongation on the extrapolation of the initial straight line portion of the stress-strain curve.
**B.Q.I. - (Beaming Quality Index) - Defects (broken filaments, strip backs, nubs, etc.) per million yards in beaming. Said B.Q.I. tested on an Ultra Yarn Inspector, Model 1007, Serial 2594, Lindly Corp., Mineola, N. Y. - Major sensitivity set at 4.0%; Minor sensitivity set at 3.0%.

EXAMPLE II

Polyethylene terephthalate yarns of 1300 ± 20 denier comprising 192 filaments were prepared with substantially the same apparatus and conditions as described in Example I except that several degrees of pretension were used. In Table II are listed properties of these yarns processed using different pretensions showing the range of pretension for polyethylene terephthalate having improved mechanical quality.

TABLE II

| Sample No. | Pretension (gpd) | B.Q.I. | Tenacity (gpd) | Elongation at Break % |
|---|---|---|---|---|
| A | None | Many wraps and break-outs | | |
| B | .007 | 150 | 9.0 | 17.8 |
| C | .03 | 14 | 9.2 | 18.7 |

TABLE II-continued

| Sample No. | Pretension (gpd) | B.Q.I. | Tenacity (gpd) | Elongation at Break % |
|---|---|---|---|---|
| D | .07 | 20 | 9.1 | 18.4 |
| E | .16 | 250 | 8.9 | 17.8 |
| F | .23 | 700 | 8.6 | 17.0 |
| Commercial Yarn Sample Control | | 210 | 8.7 | 13.7 |

EXAMPLE III

This example illustrates the utility of this invention in obtaining very high processing speeds. Polyethylene terephthalate filaments were prepared using substantially the same apparatus and conditions used in Example I except that the throughput rate was increased to 70.5 pounds per hour resulting in a drawn yarn speed of 12,850 feet per minute. Trials were run with and without pretension. Table III lists the pretensions used and resulting yarn properties. Desired draw ratio of > 6 could not be attained with no pretension due to excessive break outs.

TABLE III

| | Run III A | Run III B |
|---|---|---|
| Pretension, G.P.D. | 0 | 0.06 |
| Draw Ratio Attainable | 5.90 | 6.2 |
| Denier | 1304 | 1285 |
| Ultimate Elongation, % | 14.8 | 14.5 |
| Ultimate Tensile Strength, (gpd) | 8.8 | 9.3 |
| B. Q. I.* | 500 | 40 |

*B. Q. I. = Beaming Quality Index

EXAMPLE IV

This example illustrates the combined spinning and drawing utilizing polycaproamide polymer. Polycaproamide polymer flakes having a 75 formic acid relative viscosity (ASTMD 789-53T) and hot water extractables content of about 1.3% by weight was extruder melted at 262° C. and pumped through a filter to a 204 hole spinnerette preparing 1260/drawn denier round cross section yarn at 35 pounds per hour throughput. The filaments were quenched by air at a temperature of 78° F. while passing from the spinnerette to the directly connected drawing system. The yarn filaments were contacted and lubricated using a finish roll. The yarn filament bundle passed over a pretension roll system in five wraps maintained at ambient room temperature. The pretension was controlled by a speed differential between the pretension roll system and the feed roll system. The yarn bundle was then passed over in twelve wraps a feed roll system. The yarn then passed through a draw point localizing zone wherein steam was contacted with the yarn wherein its temperature was raised substantially immediately to 120° C. The yarn then passed over in 16 wraps a draw roll system maintained at a temperature of 130° C. and operating at a speed of 5950 feet per minute. The yarn bundle was then fed through an entangling zone wherein the air temperature was ambient room temperature and the pressure was 90 psig. The yarn then passed over a relaxation roll system and then was wound up at 5835 feet per minute.

The properties of yarn produced under the above-described conditions (A), yarn spun and drawn using the same polymer under prior art conditions (B), and yarn commercially sold in the trade having the same denier and filament count (C) are shown in Table IV. It is again apparent that the properties and mechanical quality of the yarns produced within the teaching of this invention are superior to the yarns produced by the prior art.

TABLE IV

| Sample | Pre-tension (gpd) | Denier | Elonga-tion at Break | Ultimate Tensile Strength (gpd) | Tough-ness | B. Q. I* |
|---|---|---|---|---|---|---|
| A-1 | None | 1260 | 17 | 9.1 | 0.91 | 495 |
| A-2 | 0.009 | 1289 | 22 | 9.3 | 1.27 | 78 |
| A-3 | 0.015 | 1276 | 20 | 9.3 | 1.09 | 108 |
| B | — | 1282 | 16 | 9.0 | 0.89 | 630 |
| C | — | 1260 | 17 | 9.0 | 0.91 | 225 |

* B. Q. I. = Beaming Quality Index

EXAMPLE V

This example illustrates the combined spinning and drawing to produce a textile grade yarn utilizing polycaproamide polymer. Polycaproamide polymer flakes having a 45 formic acid relative viscosity (ASTMD 789-53T) and water extractables content of about 1.5% by weight, was extruded at 262° C. and pumped through a filter to a 210 hole spinnerette preparing 3150 drawn denier trilobal cross section yarn as described in U.S. Pat. No. 3,308,221 at 45 pounds per hour position throughput. The undrawn filaments were quenched by ambient air at 72° F. while passing from the spinnerette to the directly connected drawing system. The yarn filaments were contacted by a finish application roll. The yarn filament bundle then passed over a pretension roll system maintained at ambient room temperature and operating at controlled speed. The pretension was controlled at 0.12 grams per denier, a speed differential between the pretension roll system and the feed roll system. The yarn bundle was then passed over a feed roll system using three wraps. The yarn then passed through a draw point localizing zone wherein steam was contacted with the yarn wherein its temperature was raised substantially immediately to 105° C. The yarn then passed over a draw roll system maintained at a temperature of 120° C. and operated at a speed of 3,800 feet per minute. The yarn bundle was then fed through an entangling zone wherein the air entering the jet was at room temperature and at a pressure of 80 psig. The yarn then passed over a relaxation roll system and then was wound up at 3,500 feet per minute. The properties of the nylon yarn spun under the above-described conditions are shown in Table V with those of a zero pretension control run.

TABLE V

| Run No. | Pretension Level | B. Q. I. | Strength (gpd) | Ultimate Elongation, % |
|---|---|---|---|---|
| A | O[1] | 700 | 4.3 | 25 |
| B | 0.12 | 30 | 4.8 | 28 |

[1]Excessive movement of yarn entering draw zone resulted in many roll wraps.

The B yarn gave superior performance and carpet appearance over this rating when a yarn processed through texturing into high-low loop construction carpets.

EXAMPLE VI

Polyester polymer having an intrinsic viscosity of 0.64 containing 0.09 percent $TiO_2$ was spun at a throughput rate of 5.2 pounds per hour using a 32 hole spinnerette. With the exception of feed roll surface speed, feed roll surface temperature and undrawn denier of the combined filament bundle leaving the quench stack, which were respectively 1638.2 feet per minute, 65° C., and 750, the conditions described in Example I were employed. The properties of the yarn produced under the above-described conditions (A), and yarn spun and drawn separately from the same polymer (B) are listed in Table VI. It is again apparent that the properties of the yarn produced are superior using the art of this invention.

TABLE VI

| Sample | Fiber I. V. | Pretension | Denier | Tenacity | Elongation at Break | Toughness | B.Q.I. | % Pirns Defective Dye* |
|---|---|---|---|---|---|---|---|---|
| A | 0.62 | 0.011 | 151 | 5.1 | 26 | 1.08 | 90 | <1 |
| B | 0.62 | — | 152 | 4.8 | 25 | 0.89 | 280 | 2 |

*Percent Pirns Defective Dye are those pirns in a 100 unit sample that produce a detectable streak when false twist textured and placed in a double bar knitted fabric and dyed using conventional polyester dyestuffs.

The product properties obtained by the process of this invention can be modified, if desired, by after treatments, such as stress relaxation, tensilization, texturization, crimping, etc.

It will be apparent to those skilled that many widely different embodiments of this invention may be made without departing from the scope and spirit hereof, and it is therefore not intended to be limited except as defined in the claims.

We claim:

1. A process of producing drawn polyethylene terephthalate yarn which comprises continuously melt-spinning at a temperature of about 295° C. filaments of a synthetic linear fiber-forming polyethylene terephthalate polymer having an intrinsic viscosity of at least 0.90 dl., quenching the spun filaments, pretensioning the quenched filaments by subjecting them to a tension of about 0.03 and 0.07 gram per denier at ambient room temperature on pretensioning rolls immediately prior to feed rolls, said feed rolls being maintained at ambient temperature, and thereafter instantaneously and simultaneously heating the pretensioned filaments and drawing them between draw rolls and said feed rolls at a temperature in the range of from about 70° C. to about 250° C. in a heated draw point localizing zone between said feed rolls and said draw rolls.

2. The process of claim 1 wherein said pretensioning of the filaments is maintained constant at a tension of 0.03 gram per denier.

3. The process of claim 1 wherein said pretensioning of the filaments is maintained constant at a tension of 0.07 gram per denier.

* * * * *